US005881423A

United States Patent [19]

Shumway et al.

[11] Patent Number: 5,881,423

[45] Date of Patent: Mar. 16, 1999

[54] INTEGRATED SPONGE MOP AND SCRUBBING ELEMENT

[76] Inventors: Craig S. Shumway; Amy M. Shumway, both of 4506 Dartford Ct., Orlando, Fla. 32826

[21] Appl. No.: 831,668

[22] Filed: Apr. 9, 1997

[51] Int. Cl.[6] ..... A47L 13/12; A47L 13/254; A47L 13/258

[52] U.S. Cl. ..... 15/118; 15/119.2

[58] Field of Search ..... 15/118, 119.1, 15/119.2, 228, 244.1, 244.2; 134/6

[56] References Cited

U.S. PATENT DOCUMENTS

| | | | |
|---|---|---|---|
| 3,050,761 | 8/1962 | Morgan | 15/119.2 |
| 3,656,202 | 4/1972 | Paton | 15/118 |
| 4,285,086 | 8/1981 | Whyte | 15/119.2 |
| 4,864,675 | 9/1989 | Jones | 15/119.2 |
| 5,371,917 | 12/1994 | Hoagland | 15/118 |
| 5,488,750 | 2/1996 | Vosbikian et al. . | |

*Primary Examiner*—Terrence R. Till
*Attorney, Agent, or Firm*—James H. Beusse; Holland & Knight

[57] ABSTRACT

A mopping sponge assembly including a sponge having one face adapted for mopping and a scrubbing element attached to the sponge in a position such that a face of the scrubbing element is recessed away from the face of the sponge when the sponge is used with a normal mopping pressure. The scrubbing element is driven into contact with a surface being mopped when pressure on the sponge is increased above the normal mopping pressure.

6 Claims, 1 Drawing Sheet

FIG. 3
FIG. 4
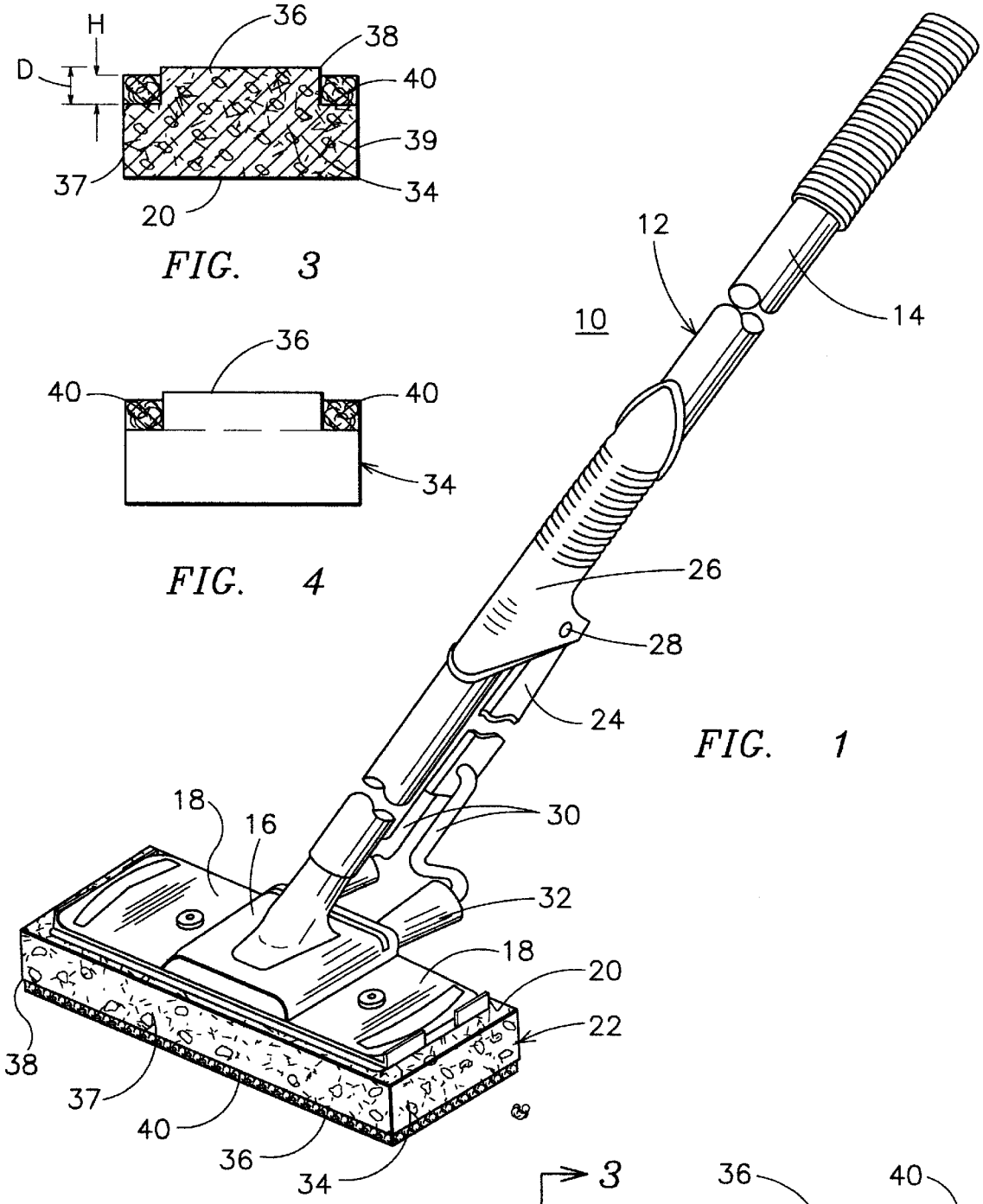
FIG. 1
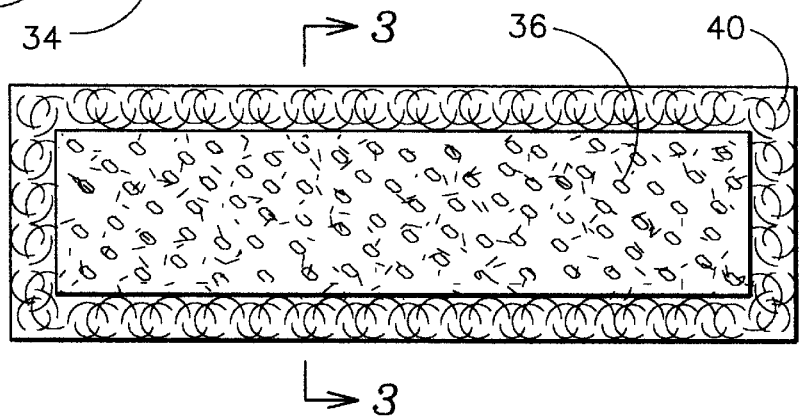
FIG. 2

INTEGRATED SPONGE MOP AND SCRUBBING ELEMENT

BACKGROUND OF THE INVENTION

The present invention relates to multipurpose mopping sponges and, more particularly, to a sponge assembly which includes both a mopping element and a scrubbing element.

Sponges, either synthetic or natural, have long been used for mopping surfaces and absorbing liquid. Many of these sponges have been assembled with a synthetic scrubbing element bonded to one surface. For example, one such sponge is a rectangular shaped block with one of its major faces covered by a mesh type material. For normal mopping, an exposed sponge face is brought into contact with a surface but when scrubbing is necessary, the sponge is inverted and the mesh material brought to bear on the surface. Of course, whatever material is being cleaned from the surface is brought into contact with the user's hand through such inversion.

The user can be somewhat isolated from contact with surface material by attaching the sponge to a handle. A number of short-handle sponge assemblies are commercially available. With a longer handle, the assembly becomes a floor mop. In a typical floor mop, the sponge is attached to a backing plate which precludes being able to invert the sponge. The scrubbing element may be attached to the backing plate by a separate holding mechanism so that inverting the mop assembly lifts the sponge from the floor and places the scrubbing element in contact with the floor. An exemplary form of such a floor mop is shown in U.S. Pat. No. 5,488,750.

While use of the floor mop in an inverted position does not expose the user's hands to dirty material from the floor in the same manner as a hand-held sponge, having to invert the mop, scrub to remove material, revert back to the sponge to mop the removed material and determine if more scrubbing is necessary is both inconvenient and time consuming. Accordingly, it would be advantageous to provide a sponge assembly useful as a hand-held cleaner or in a handled mop which overcomes the need to invert the assembly between scrubbing and mopping.

SUMMARY OF THE INVENTION

The above and other disadvantages of the prior art are addressed in one form of the present invention in which a mopping sponge includes at least one face adapted for mopping a surface, the one face being circumscribed by a rabbet such that the one face is displaced from a main body of the sponge. A scrubbing element, such as a nylon mesh material, is positioned in the rabbet and attached to the sponge. The scrubbing element has a thickness which is less than the height of the one face above the sponge body so that the scrubbing element does not contact the surface when the face of the sponge engages the surface with a normal mopping pressure. However, if the pressure on the sponge is increased, the natural resiliency or elasticity of the sponge material will compress and allow the scrubbing element to contact the surface. Reducing the pressure allows the sponge to return to its nominal shape so that the scrubbing element is raised away from the surface. In this manner, the user does not have to invert the sponge for scrubbing nor place his/her hand in contact with the material being scrubbed or mopped.

BRIEF DESCRIPTION OF THE DRAWINGS

For a better understanding of the present invention, reference may be had to the following detailed description taken in conjunction with the accompanying drawings in which:

FIG. 1 is a perspective view of a mop incorporating one embodiment of the present invention;

FIG. 2 is a bottom plan view of one form of sponge assembly of the present invention;

FIG. 3 is a cross-sectional view taken along lines 3—3 of FIG. 2; and FIG. 4 is a cross-sectional view taken along lines 3—3 of FIG. 2 showing an alternate embodiment.

DETAILED DESCRIPTION OF THE INVENTION

FIG. 1 illustrates one form of sponge mop assembly incorporating the teachings of the present invention. The mop assembly 10 of FIG. 1 utilizes a conventional butterfly handle assembly 12 including a handle 14 connected to sponge support member 16. The member 16 is coupled to a pair of sponge backing plates 18, each of the plates 18 being attached to a face 20 of sponge assembly 22. A lever arm 24 is pivotably attached to sliding member 26 at pivot point 28 and extends generally parallel to handle 14 into engagement with a pair of squeeze arms 30. Each of the arms 30 are fitted with rollers 32 which contact respective ones of the backing plates 18. When the member 26 is slid downward on handle 14 toward sponge 22, the lever arm 24 pushes squeeze arms 30 against plates 18 forcing the plates to pivot toward one another and squeezing sponge 22 between them so as to squeeze liquid from the sponge assembly 22. A more detailed description of a butterfly type squeeze mop is shown in U.S. Pat. No. 5,488,750.

Referring to FIGS. 2 and 3, which are a bottom plan view and a cross-sectional view, respectively, of the sponge assembly 22, in conjunction with FIG. 1, it will be seen that applicants' sponge assembly 22 comprises a cellulose sponge 34 having a face 36, opposite backing face 20, positioned for normal mopping of a surface by holding of handle 14. A rabbet 38 is defined about the periphery of face 36 and provides a seat for receiving a scrubbing element 40. The scrubbing element 40 may be a narrow strip of nylon mesh or other suitable material for scrubbing. The element 40 is bonded to the body of sponge 34 and has a vertical dimension or height H less than the depth D of rabbet 38 less than the such that element 40 does not contact a surface being mopped when normal mopping (not scrubbing) pressure is being applied. However, if a user applies increased mopping pressure (downward toward the surface being mopped), the natural resiliency of the sponge 34 will allow the sponge portion defined by face 36 to be compressed so that scrubbing element 40 comes into contact with the surface being mopped. The scrubbing element 40 preferably extends fully about the periphery of face 36 which increases the effective scrubbing area and allows the user to engage the scrubbing element by exerting either a flat downward pressure or by tilting the sponge assembly forward or backward. However, it is apparent that the scrubbing element could be a strip along a front or rear edge of sponge assembly 22 and not extend around the sponge. Furthermore, while the scrubbing element is shown recessed in rabbet 38, it is also possible to attach the element to a leading edge 37 or trailing edge 39 of the sponge 34 or even to place a strip of scrubbing material in a groove or slot cut through face 36. The significant feature of the invention is the recessing of the scrubbing element from the face 36 during normal mopping action and the positioning of the scrubbing element such that the scrubbing element contacts a surface being cleaned when pressure on the sponge assembly is increased to compress the sponge 34.

The raised face 36 may be formed by cutting or molding the rabbet 38 in the sponge 34. Alternately, the sponge 34 may be formed by bonding a smaller section of sponge containing the face 36 to a larger section of sponge (FIG. 4), the differences in dimensions of the two sections serving to establish the rabbet 38. The dimension of the rabbet 38 in the vertical direction as shown at D in FIG. 3 and the height of scrubbing element 40 indicated at H are selected such that element 40 is normally recessed at least 0.125 inches below face 36 and preferably about 0.25 inch. However, it will be recognized that different dimensions are appropriate for different applications. A heavy duty mop may require a greater displacement than a light duty mop. Further, when the sponge assembly 22 is used as a hand-held mopping sponge, i.e., not attached to a handle, it may be preferable to use a recess dimension of about 0.125 inch in order to minimize the additional pressure needed to bring the scrubbing element into contact with a surface being cleaned.

While the invention is illustrated in its application to a handled mop, it will be recognized that the sponge assembly with recessed scrubbing element could be used as a hand-held sponge for general cleaning of cabinet tops or other surfaces. The sponge assembly could also be attached to a short handle for use in cleaning dishware. It is intended therefore that the invention not be limited to the specific disclosed embodiment but be interpreted within the full spirit and scope of the appended claims.

What is claimed is:

1. A sponge mop head comprising:

a substantially planar backing plate;

a sponge attached to said backing plate and having a first surface positioned for mopping when said backing plate is assembled to a handle;

a scrubbing element attached to said sponge in a position such that a face of said scrubbing element is recessed away from said first surface when said mop head is used with a normal mopping pressure, said scrubbing element being driven into contact with a surface being mopped when pressure on said mop head is increased above said normal mopping pressure, said sponge being generally rectangular and having a leading edge, a trailing edge and a pair of opposite end edges defining a periphery of said first surface including a rabbet defined along at least a major extent of each of said leading and trailing edges, said scrubbing element comprising a separate strip of scrubbing material placed in each of said rabbets.

2. The sponge mop head of claim 1 wherein said rabbet extends around the periphery of said first surface and said scrubbing element is co-extensive with said rabbet.

3. A sponge mop head assembly comprising a backing plate adapted for attachment to a handle, a first block of sponge material attached to said backing plate, said block having a mopping surface characterized by a generally flat area indented along all edges, a generally continuous strip of scrubbing material circumscribing said flat area and recessed from said mopping surface, said scrubbing material being planar with said mopping surface only upon exertion of a force on said backing plate exceeding a normal mopping force.

4. The sponge mop head of claim 3 wherein said mopping surface is formed by a secondary block of sponge material adhesively bonded to said first block.

5. A mopping sponge assembly comprising:

a sponge having at least one face adapted for mopping;

a scrubbing element attached to said sponge in a position such that a face of said scrubbing element is recessed away from said one face of said sponge when said sponge is used with a normal mopping pressure, said scrubbing element being driven into contact with a surface being mopped when pressure on said sponge is increased above said normal mopping pressure, said sponge being generally rectangular and having a leading edge, a trailing edge and a pair of opposite end edges defining a periphery of said one face of said sponge, and including a rabbet defined along at least a major extent of each of said leading and trailing edges, said scrubbing element comprising a separate strip of scrubbing material placed in each of said rabbets.

6. The sponge assembly of claim 5 wherein said rabbet extends around the periphery of said at least one face and said scrubbing element is co-extensive with said rabbet.

* * * * *